US008312969B2

(12) United States Patent
Hoang

(10) Patent No.: US 8,312,969 B2
(45) Date of Patent: Nov. 20, 2012

(54) LUBRICATION SYSTEM FOR AIRCRAFT ENGINE

(75) Inventor: Tuyen Trong Hoang, Montreal (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 172 days.

(21) Appl. No.: 12/825,479

(22) Filed: Jun. 29, 2010

(65) Prior Publication Data

US 2011/0315484 A1 Dec. 29, 2011

(51) Int. Cl.
*F01D 25/20* (2006.01)

(52) U.S. Cl. ..... 184/6.11

(58) Field of Classification Search ..... 184/6.11
See application file for complete search history.

(56) References Cited

U.S. PATENT DOCUMENTS 2,239,098 A 4/1941 Hunter
2,364,119 A 12/1944 Anderson
2,399,323 A 4/1946 Chester
2,404,765 A * 7/1946 Valentyne ..... 244/135 R
2,774,365 A * 12/1956 Stewart et al. ..... 137/44
2,831,490 A * 4/1958 Simcock ..... 137/38
2,942,610 A * 6/1960 Klank et al. ..... 137/43
2,975,793 A * 3/1961 Klank, Jr. ..... 137/43
2,982,374 A 5/1961 Hughes et al.
2,983,331 A * 5/1961 Helsley, Jr. ..... 96/212
3,016,912 A * 1/1962 Klank, Jr. et al. ..... 137/43
3,180,345 A * 4/1965 Klank, Jr. ..... 137/43
3,685,528 A * 8/1972 Holland ..... 137/43
4,287,913 A 9/1981 Bennett et al.
4,346,786 A 8/1982 Midgley
4,369,938 A * 1/1983 Kress ..... 244/135 R
4,531,358 A * 7/1985 Smith ..... 60/39.08
4,856,273 A 8/1989 Murray
4,947,963 A * 8/1990 Aho, Jr. ..... 184/6
5,085,677 A 2/1992 Ville et al.
7,530,430 B2 5/2009 Hoang et al.

* cited by examiner

*Primary Examiner* — William E Dondero
*Assistant Examiner* — Mark K Buse
(74) *Attorney, Agent, or Firm* — Norton Rose Canada LLP

(57) ABSTRACT

A lubrication system for an aircraft engine includes a lubrication fluid tank and a fluid passage communicating with the tank to define an entry of the passage inside the tank. The entry is positioned in a location submerged in the lubrication fluid for delivery of the lubrication fluid under a pressure differential, from the tank to the lubrication system regardless of the tank or aircraft attitude.

13 Claims, 6 Drawing Sheets

LUBRICATION SYSTEM FOR AIRCRAFT ENGINE

TECHNICAL FIELD

The invention relates generally to aircraft engines and more particularly to an pressure lubrication system of aircraft engines.

BACKGROUND OF THE ART

Engines in aircraft normally require high quality lubrication which can be achieved only by forced circulation or pressure lubrication systems. This requires a tank from which the lubricating fluid is supplied, a pump and a circulation network for movement of the lubricating fluid between the tank and the various bearings of the engine. In a conventional oil-filled tank used only for normal flight, oil is drawn off through an outlet at the bottom of the tank to ensure a continuous supply at all times. However, to obtain a continuous supply of oil from the tank in an aircraft which turns at steep angles or flies inverted, outlets must be placed at various positions in the periphery of the tank, or movable parts must be used in order that at least one outlet will be in the lowest part of the tank and thus submerged no matter what orientation is assumed by the tank with respect to the downward sense of the vertical. The conventional tank therefore requires a complicated configuration.

Accordingly, there is a need to provide an improved pressure lubrication system of aircraft engines which may be useful for inverted flight and/or other flight attitudes.

SUMMARY

In one aspect, the described subject matter provides an aircraft engine oil system comprising: a tank for containing oil, having in a upright orientation, a top and a bottom, and a geometrical center defined as a centroid of the tank shape, the tank configured to have an oil level surface above the geometrical center when the oil has a required minimum volume and to have the oil level surface spaced apart from the top of the tank when the oil has a required maximum volume; an oil inlet communicating with an oil pump, the inlet being located in the geometrical center of the tank and being submerged in the oil for delivery of the oil under a pressure differential between the tank to the oil system; and an oil return communicating with the tank for returning oil from the oil system back to the tank.

In another aspect, the described subject matter provides a pressure lubrication system for an aircraft engine, comprising: a lubrication fluid circulation network; a tank for containing a lubrication fluid, having in a upright orientation, a top and a bottom; a fluid returning tube communicating with the tank and the lubrication fluid circulation network for returning the lubrication fluid from the lubrication fluid circulation network back to the tank; and a pump for pumping the lubrication fluid into the lubrication fluid circulation network, the pump having an inlet positioned inside the tank in a location such that the pump inlet is submerged in the lubrication fluid in the tank regardless of the tank orientation.

Further details of these and other aspects of the described subject matter will be apparent from the detailed description and drawings included below.

DESCRIPTION OF THE DRAWINGS

Reference is now made to the accompanying figures depicting aspects of the described subject matter, in which.

DETAILED DESCRIPTION

Figure 1:
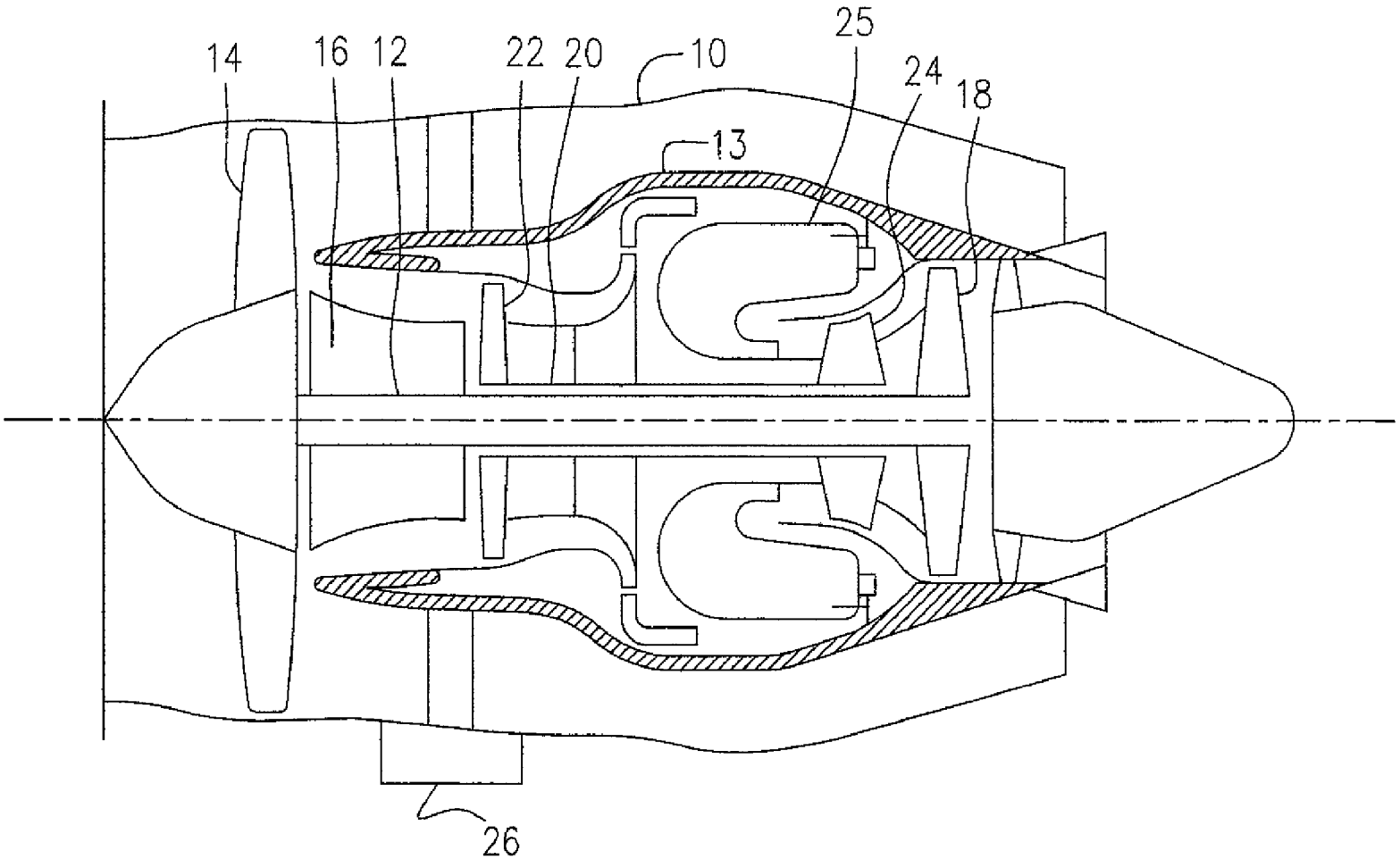
FIG. 1 is a schematic cross-sectional view of a turbofan gas turbine engine as an exemplary application of the described subject matter.

FIG. 1 schematically illustrates a turbofan gas turbine engine which is mounted on an aircraft, and which includes a housing or nacelle 10, a core casing 13, a low pressure spool assembly seen generally at 12 which includes a fan assembly 14, a low pressure compressor assembly 16 and a low pressure turbine assembly 18, and a high pressure spool assembly seen generally at 20 which includes a high pressure compressor assembly 22 and a high pressure turbine assembly 24. The core casing 13 surrounds the low and high pressure spool assemblies 12 and 20 in order to define a main fluid path (not indicated) therethrough. In the main fluid path there is provided a combustor 25 in which a combustion process takes place and produces combustion gases to power the high and low turbine assemblies 24 and 18. A pressure lubrication system generally indicated at 26 is provided to generate pressure lubricant circulation for engine components such as bearings of the low and high pressure spool assemblies 12 and 20.

Figure 2:
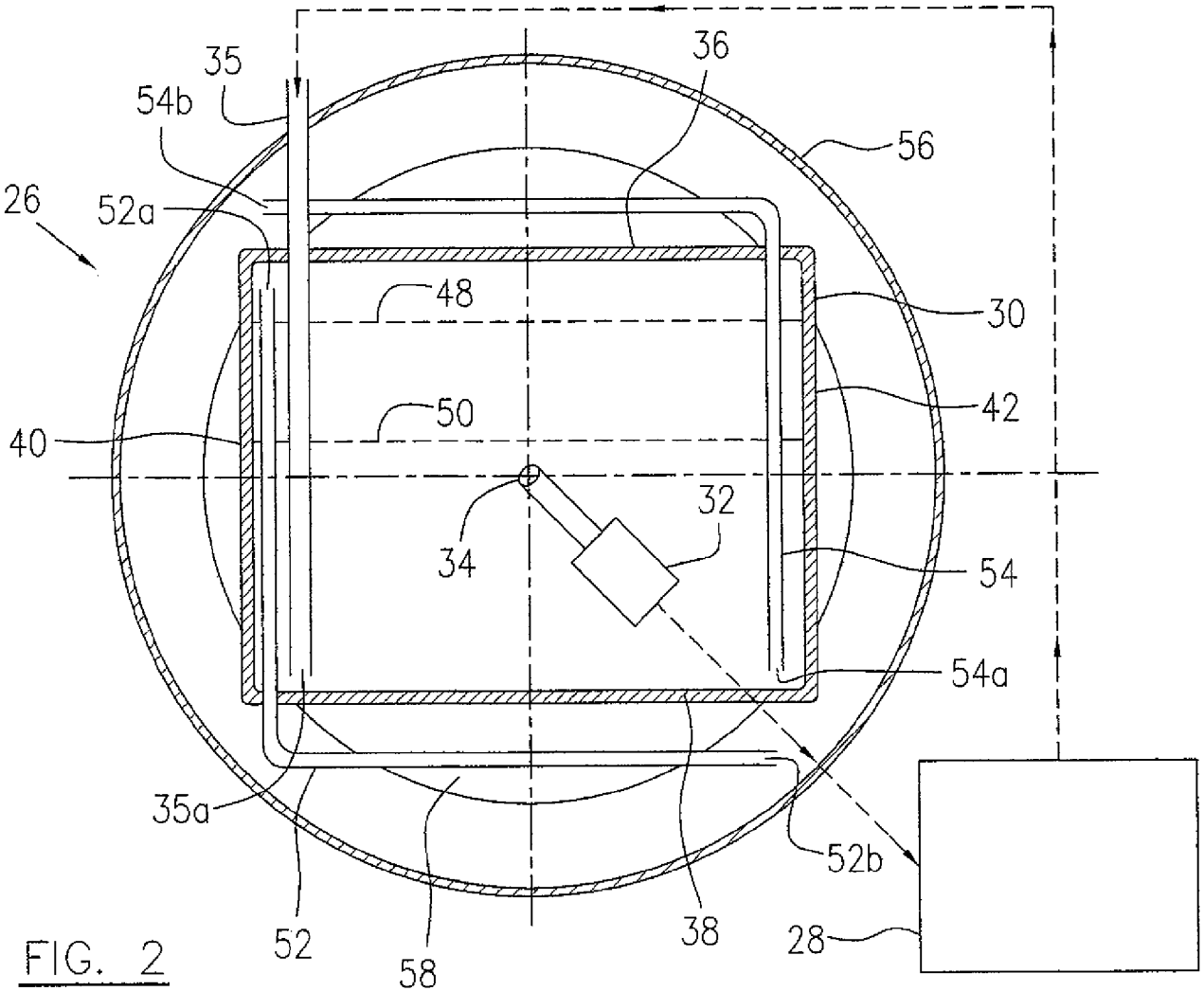
FIG. 2 is a schematic illustration of a lubrication fluid circulation network for use in the engine of FIG. 1, with a cross-sectional view of a tank of the lubrication fluid circulation network showing the configuration of the tank in an upright orientation.

Referring to FIGS. 1 and 2, the pressure lubrication system 26 such as a pressure oil system generally includes a lubrication fluid circulation network 28 through the engine bearing chambers (not shown) for distribution of lubrication fluid to the bearings, and a tank 30 (such as an oil tank) to define a capacity for containing the lubrication fluid as a source of the lubrication fluid supply of the lubrication fluid circulation network 28. A pump 32 is provided for pumping the lubrication fluid from the tank 30 into the lubrication fluid circulation network 28. The pump 32 which may be positioned either inside or outside of the tank 30, has an inlet 34 for intake of the lubrication fluid in the tank 30. The inlet 34 may be positioned in a central area inside the tank 30, such as in a geometrical center (or centroid) of the tank 30, when the pump 32 is positioned inside the tank 30. A fluid returning tube 35 may be provided to communicate the tank 30 with the fluid lubrication fluid circulation network 28 for directing a returning flow of the lubrication fluid from the lubrication fluid circulation network 28 into the tank 30.

It is known that in geometry, the centroid or geometric center of a plane figure or two-dimensional shape X is the intersection of all straight lines that divide X into two parts of equal moment bout the line. Informally, it is the "average" of all points of X. The definition extends to any object X in n-dimension space: its centroid is the intersection of all hyperplanes that divide X into two parts of equal moment.

Figure 6:
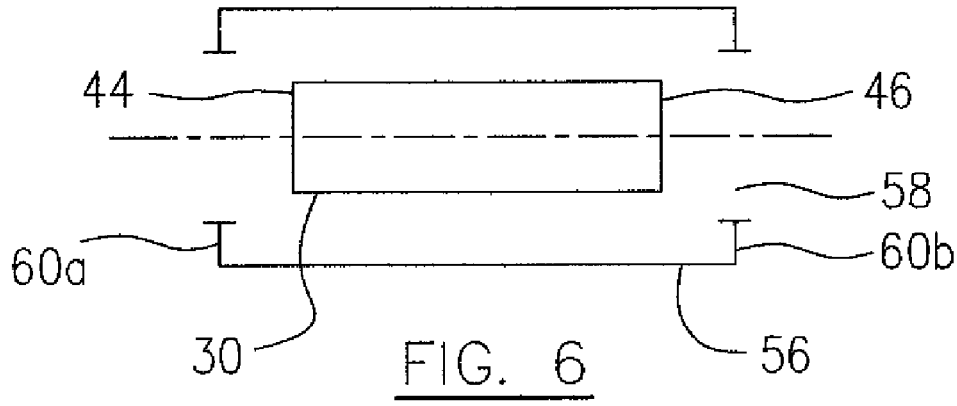
FIG. 6 is a schematic longitudinal cross-sectional view of the tank of FIG. 2, showing front and rear ends of the tank.

The tank 30 therefore may be of any suitable shape, such as a rectangular configuration as shown in FIG. 2. The tank 30 as shown in FIG. 2 is in an upright orientation which is a normal orientation during engine operation when the aircraft is grounded or in cruise flight, and has top and bottom walls 36, 38, opposed side walls 40 and 42 and front and rear walls 44, 46 (see FIG. 6). The tank 30 defines the capacity of the tank 30 such that a lubrication fluid level surface 48 in the tank 30 is spaced apart from the top wall 36 of the tank 30 when the lubrication fluid has a required maximum volume for the tank 30 and a lubrication fluid level surface 50 in the tank 30 is in a predetermined location above the inlet 34 when the lubrication fluid has a required minimum volume for the tank 30, in order to have the pump inlet 34 submerged in the lubrication fluid.

Figure 3:
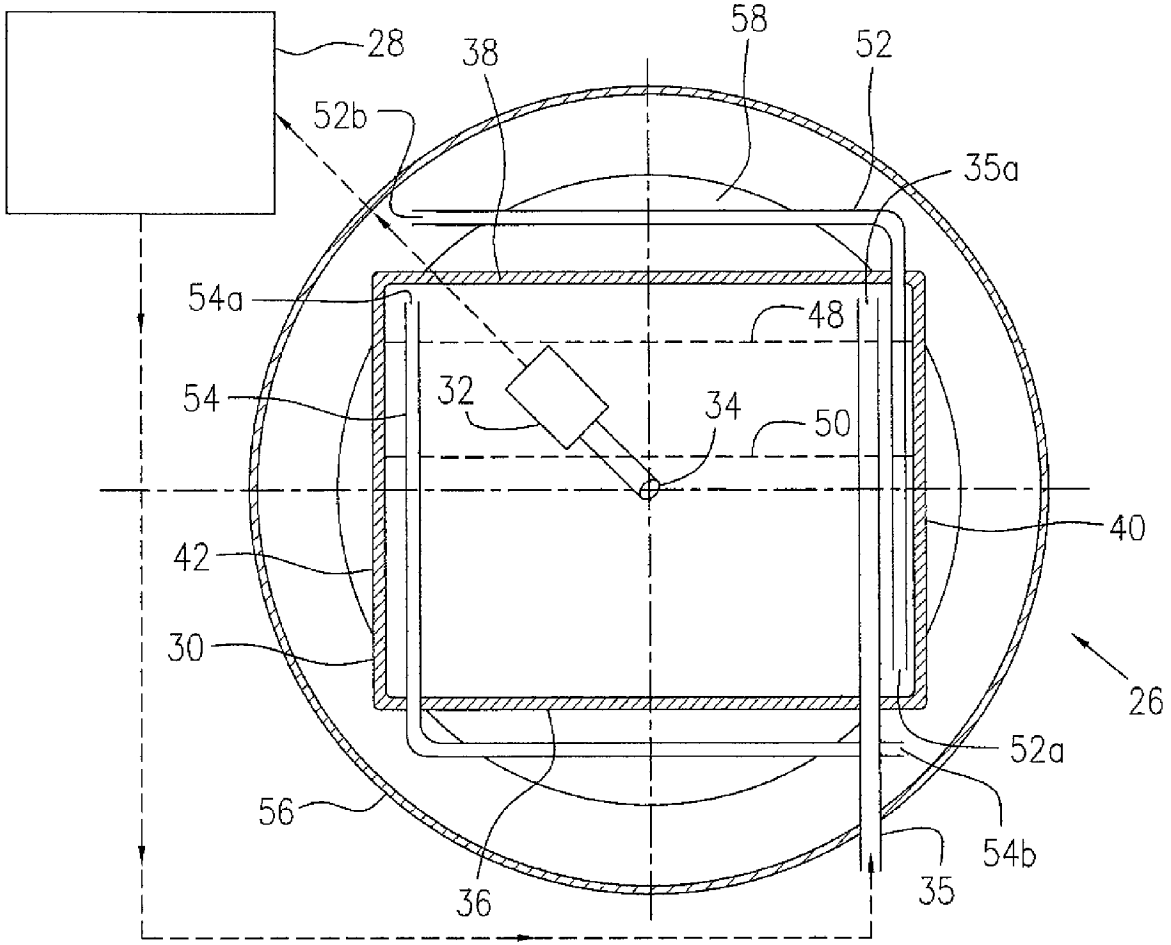
FIG. 3 is a schematic illustration of the lubrication fluid circulation network, with a cross-sectional view of the tank of FIG. 2 showing the tank in an inverted orientation.
Figure 4:
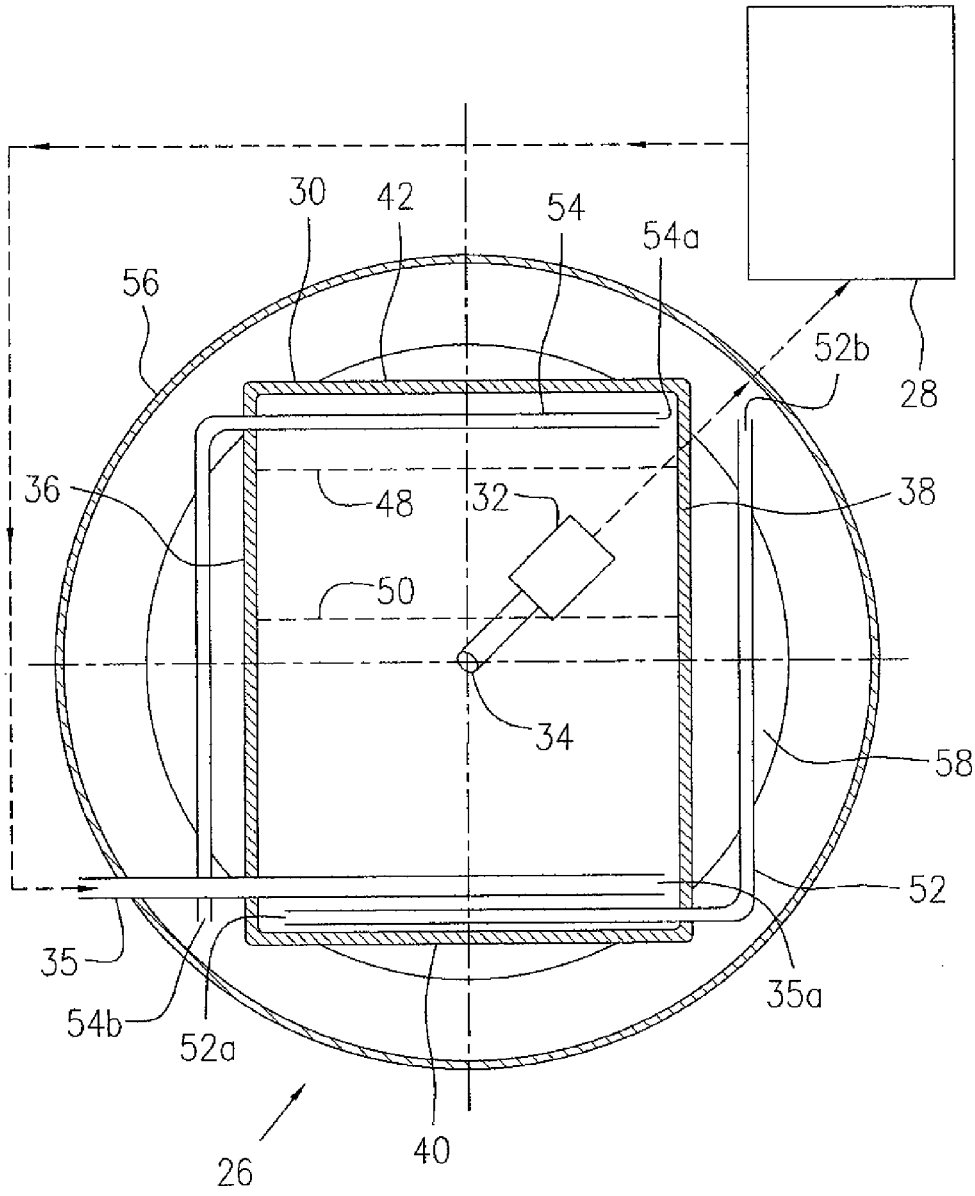
FIG. 4 is a schematic illustration of the lubrication fluid circulation network, with a cross-sectional view of the tank of FIG. 2 showing the tank in a 90° orientation.
Figure 5:
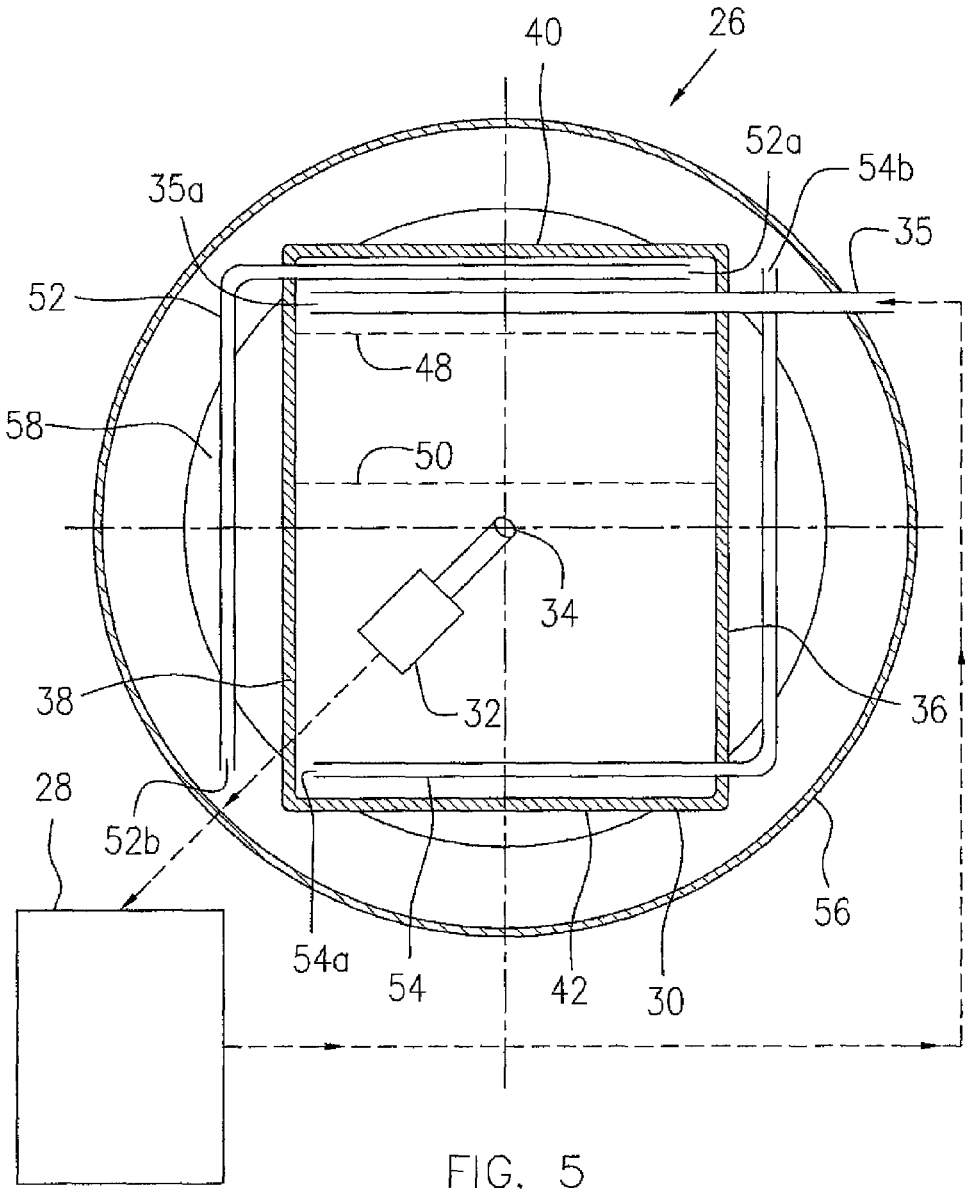
FIG. 5 is a schematic illustration of the lubrication fluid circulation network, with a cross-sectional view of the tank of FIG. 2 showing the tank in a 270° orientation.

FIGS. 2-5 illustrate four typical orientations of the tank 30 and lubrication fluid circulation network 28 when the aircraft changes attitude during flight. As already mentioned, FIG. 2 illustrates an upright orientation of the tank 30 when the aircraft is grounded or in cruise flight. FIG. 3 illustrates an inverted orientation of the tank 30 during an inverted flight of the aircraft. FIG. 4 illustrates a 90° rotated orientation of the tank 30 during a 90° knife-edge flight of the aircraft. FIG. 5 illustrates a 270° rotated orientation of the tank 30 during a 270° knife-edge flight of the aircraft.

As shown in FIGS. 2-5, the pump inlet 34 is always submerged in the lubrication fluid contained in the tank 30 because the inlet 34 is positioned in this central area inside the tank 30 and therefore the lubrication fluid level surface 50 in the tank 30 is always above the location of the pump inlet 34 even when the lubrication fluid remaining in the tank 30 is at the required minimum volume, regardless of the tank orientation (upright, inverted, 90° or 270° orientations).

It is noted that the pump inlet 34 may be positioned off the geometric center of the tank 30 provided that the lubrication fluid level surface 50 (when at the minimum volume of the fluid) in the tank 30 is always above the location of the pump inlet 34 in any tank orientation, thereby ensuring lubrication fluid supply to the pressure lubrication system 26 of the engine in any flight attitude.

The pump 32 may be positioned outside the tank 30. A fluid passage (not indicated) may be provided extending through a wall of the tank 30 to communicate the tank 30 with the pump 32 for delivery of the lubrication fluid from the tank through the pump 32 to the lubrication fluid circulation network 28, under a pressure differential generated by the pump. In this embodiment, the fluid passage has an open end (same as the inlet 34 shown in FIG. 2) defining a passage entry which is positioned in the same location as the pump inlet 34, as previously described with reference to FIG. 2. In that previously described embodiment wherein the pump 32 is provided within the tank 30, the fluid passage for delivery of lubrication fluid from the tank 30 to the lubrication fluid circulation network 28, is defined by the internal passage of the pump 32, optionally with input and/or output tube extensions.

As shown in FIGS. 2-5, there is always a space within the tank 30 above the lubrication fluid level surface 50, even when the lubrication fluid is in the required maximum volume, regardless of the tank orientation.

The system 26 may be further provided with a pair of vent tubes 52 and 54 each having an inlet 52*a* and 54*a* respectively, positioned inside the tank 30, and an outlet 52*b* and 54*b* respectively, positioned outside the tank 30. The vent tubes 52 and 54 are configured and positioned to have the inlet 52*a* (or 54*a*) of one vent tube located in a space above the lubrication fluid level surface 48 for ventilation when in the fluid has a required maximum volume, and to have the outlet 54*b* (or 52*b*) of the other vent tube located above the lubrication fluid level surface 48 in order to prevent lubrication fluid from escaping the tank 30, regardless of the tank orientation, as illustrated in FIGS. 2-5.

In one embodiment as shown in FIG. 2, both of the tubes 52 and 54 may be configured in an L-shape including an inlet section having an open end defining inlets 52*a* and 54*a* respectively, and an outlet section having an open end defining the outlets 52*b* and 54*b* respectively. The inlet and outlet sections of each tube are in a substantially perpendicular relationship.

The vent tube 52 is affixed to the tank 30 such that the inlet section extends through the bottom wall 38 of the tank 30 in an upright direction to position inlet 52*a* adjacent to the top and side walls 36, 40 inside of the tank 30. The outlet section of the vent tube 52 is positioned outside of the bottom wall 38 of the tank 30 such that the outlet 52*b* is positioned below the bottom wall 38 and adjacent to the side wall 42 outside of the tank 30. This configuration and positioning of the vent tube 52 ensures that its inlet 52*a* will always be positioned above the lubrication fluid level surface 48 in the tank 30, even when in the fluid has a required maximum volume, regardless of whether the tank is upright as shown in FIG. 2 or in the 270° rotated orientation as shown in FIG. 5. Therefore when the tank 30 is in these two tank orientations, the vent tube 52 will be free of lubrication fluid therein and is available for ventilation of the tank 30.

The vent tube 54 is affixed to the tank 30 similar to that of vent tube 52, but is positioned in an opposite direction relative to the direction of the vent tube 52. Therefore, in the upright tank orientation as shown in FIG. 2, the vent tube 54 has its inlet 54*a* positioned inside the tank 30, adjacent the bottom wall 38 and the side wall 42 of the tank 30, and has its outlet 54*b* outside of the tank 30, above the top wall 36 and adjacent the side wall 40 of the tank 30. Therefore, the inlet 54*a* of the vent tube 54 is positioned in the space within the tank 30, above the lubrication fluid level surface 48 even when in the required maximum volume, regardless of whether the tank is inverted as shown in FIG. 3 or in the 90° rotated orientation as shown in FIG. 4. Therefore, the vent tube 54 will be free of lubrication fluid therein and available for ventilation of the tank 30 during these two tank orientations in which the vent tube 52 is not available for ventilation because its inlet 52*a* is submerged in the lubrication fluid.

It is understood that vent tube 54 is not available for ventilation of the tank 30 during the tank orientations shown in FIGS. 2 and 5 because the inlet 54*a* is submerged in the lubrication fluid.

When the inlet 52*a* of the vent tube 52 is submerged in the lubrication fluid in the tank 30 (when the tank is inverted as shown in FIG. 3 or in a 90° rotated orientation as shown in FIG. 4) the outlet 52*b* is located above the tank 30 and above the lubrication fluid level surface 48 in the tank 30. Therefore, the vent tube 52 in these two tank orientations will not cause lubrication fluid leakage from the tank. Similarly, the vent tube 54 will not cause lubrication fluid leakage from the tank 30 when the tank is upright as shown in FIG. 2 or in the 270° rotated orientation as shown in FIG. 5.

The fluid returning tube 35 in this embodiment includes an outlet section (not indicated) affixed to the tank 30, extending through the top wall 36 into the inside of the tank 30, for example, downwardly along the side wall 40, to position an outlet 35*a* in a location at an inner corner between the side wall 40 and the bottom wall 38 of the tank 30. Lubrication fluid returning from the lubrication fluid circulation network 28 into the tank 30, is driven by a pressure differential in the system rather than by gravity. Therefore, the fluid returning tube 35 may be otherwise attached to the tank 30 to position outlet 35*a* in any location within the tank without difficulty for proper functioning during any tank orientation as shown in FIGS. 2-5.

In FIG. 2, while the tank 30 is in the upright orientation, lubrication fluid in the tank 30 will enter the vent tube 54 through inlet 54*a* and remain in the inlet section of the vent tube 54 while the vent tube 52 will be free of oil. During an instant transient period of time while the tank orientation changes from the upright orientation as shown in FIG. 2 to the inverted orientation as shown in FIG. 3 or to the 270° rotated orientation as shown in FIG. 5, a small amount of residual lubrication fluid in tube 54 will drain out from the outlet 54*b* which will be positioned below the tank 30 in the two latter tank orientations. A temporary fluid spillage may occur in a transient period of time during every tank orientation change when a previously "sleeping" vent tube 52 or 54, is emptied of the small amount of fluid in order to be free of lubrication fluid and available for ventilation. Therefore, an apparatus or device for collecting the temporary fluid spillage may be provided.

As shown in FIGS. 2-6, a housing 56 of any shape (a cylindrical shape is shown in the drawings) may be provided to accommodate the tank 30 such that the outlets 52*b* and 54*b* of the respective vent tubes 52 and 54 are positioned within the housing 56. The housing 56 defines at least one opening 58 (see FIG. 6) for venting air. The opening 58 is disposed in a location of the housing, for example at the respective opposed front and rear ends 60*a*, 60*b* of the housing. The opening 58 may be positioned radially spaced apart from a periphery of a vertical and transverse cross-section of the housing 56. As an example of the housing, this feature is shown in the figures as two circular openings 58 defined in the opposite front and rear ends 60*a* and 60*b* of the cylindrical housing 56, coaxial to the peripheral wall (not indicated) of the housing 56. Therefore, the housing 56 defines a capacity for collecting the lubrication fluid resulting from the temporary fluid spillage during the tank orientation transition period. Any other alternative types of apparatus or arrangements for collecting the temporary fluid spillage may be used with the tank 30 and the vent tubes 52 and 54, without affecting the principle in which the tank 30 or the pressure lubrication system 26 works for inverted flight.

Figure 7:
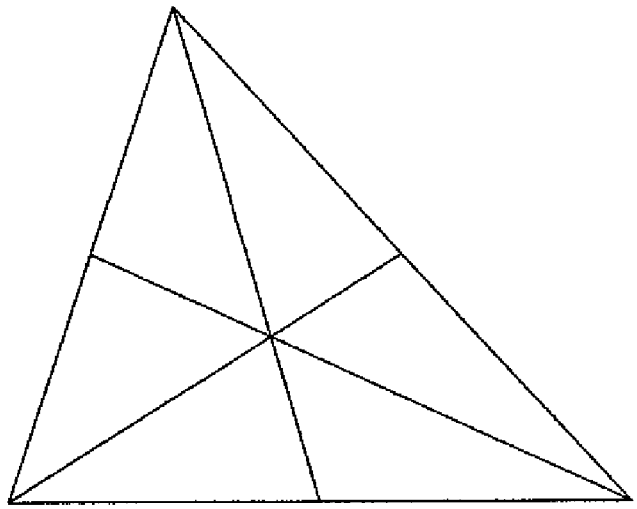
FIG. 7 is a schematic illustration of a cross-section of a tank having a non-axisymmetric triangular shape, according to another embodiment.

The above description is meant to be exemplary only, and one skilled in the art will recognize that changes may be made to the embodiments described without departure from the scope of the described subject matter. For example, a turbofan gas turbine engine is illustrated in the drawings and described as an exemplary application of the described subject matter. However, the described subject matter is applicable to other aircraft engines. As above-mentioned, a rectangular tank and a cylindrical housing which are convenient for description and illustration, are used as an example to illustrate the described subject matter. However, the tank and housing may be of any shapes. For example, the tank according to another embodiment, may have a non-axisymmetric shape such as a triangle, as illustrated in FIG. 7. The geometrical center of the tank is the centroid of the triangle and is determined by the three dividing line also as shown in FIG. 7. The method to locate the centroid of the triangle is known and will not be discussed herein. Still other modifications which fall within the scope of the described subject matter will be apparent to those skilled in the art, in light of a review of this disclosure, and such modifications are intended to fall within the appended claims.

The invention claimed is:

1. An aircraft engine oil system comprising:

a tank having a substantially closed configuration for containing substantially an entire volume of oil therein regardless of the tank being oriented upright or inverted, the tank having in a upright orientation, a top and a bottom, and a geometrical center defined as a centroid of the tank shape, the tank configured to have an oil level surface above the geometrical center when the oil has a required minimum volume and to have the oil level surface spaced apart from the top of the tank when the oil has a required maximum volume;

an oil inlet communicating with an oil pump, the inlet being located in the geometrical center of the tank and being submerged in the oil for delivery of the oil under a pressure differential between the tank to the oil system; and an oil return communicating with the tank for returning oil from the oil system back to the tank .

2. The oil system as defined in claim 1 further comprising a pair of vent tubes each having an inlet positioned inside the tank and an outlet positioned outside the tank, the vent tubes being configured and positioned to have the inlet of one vent tube located in a space above the oil level surface when the oil has the required maximum volume for ventilation and to have the outlet of the other vent tube above the oil level surface in order to prevent the oil from escaping the tank, regardless of the tank being oriented upright or inverted.

3. The oil system as defined in claim 1 further comprising a pair of vent tubes each having an inlet positioned inside the tank and an outlet positioned outside the tank, one vent tube having the inlet positioned adjacent the bottom and a first side of the tank and having the outlet positioned above the top and adjacent a second side of the tank, the second side of the tank being opposite to the first side of the tank, the other vent tube having the inlet positioned adjacent the top and second side of the tank, and having the outlet positioned below the bottom and adjacent the first side of the tank.

4. The oil system as defined in claim 3 further comprising a housing accommodating the tank and the pair of vent tubes for collecting oil leakage from the vent tubes occurring during a transient period of time between tank orientation changes, the housing having at least one opening for venting air.

5. The oil system as defined in claim 4 wherein the at least one opening is disposed in one of opposed front and rear ends of the housing.

6. The oil system as defined in claim 5 wherein the at least one opening is radially spaced apart from a periphery of a vertical and traverse cross section of the housing.

7. The oil system as defined in claim 1 wherein the oil return comprises a tube section extending downwardly from the top of the tank toward the bottom of the tank.

8. A pressure lubrication system for an aircraft engine, comprising:

a lubrication fluid circulation network;

a tank having a substantially closed configuration for containing substantially an entire volume of a lubricating fluid therein regardless of the tank being oriented upright or inverted, the tank having in a upright orientation, a top and a bottom;

a fluid returning tube communicating with the tank and the lubrication fluid circulation network for returning the lubrication fluid from the lubrication fluid circulation network back to the tank; and a pump for pumping the lubrication fluid into the lubrication fluid circulation network, the pump having an inlet positioned inside the tank in a geometrical center defined as a centroid of the tank shape such that said inlet of the pump is submerged in the lubrication fluid in the tank regardless of the tank orientation.

9. The pressure lubrication system as defined in claim 8 wherein the tank is configured to have a level surface of the lubrication fluid in the tank above the geometrical center of the tank when the lubrication fluid has a required minimum volume.

10. The pressure lubrication system as defined in claim 8 wherein the tank comprises a pair of vent tubes free of valves, for alternately venting air from the tank when the tank changes between upright and inverted orientations.

11. The pressure lubrication system as defined in claim 8 wherein the tank comprises a pair of vent tubes each having an inlet positioned in the tank and an outlet positioned outside the tank, the vent tubes being configured and positioned to have the inlet of one vent tube located in a space above a lubrication fluid level surface in the tank for ventilation and to have the outlet of the other vent tube located above the lubrication fluid level surface in the tank in order to prevent the lubrication fluid from escaping the tank, regardless of the tank being oriented in the upright or inverted orientation.

12. The pressure lubrication system as defined in claim 11 wherein the tank is configured to have the lubrication fluid level surface in the tank, spaced apart from the top of the tank when the lubrication fluid has a required maximum volume.

13. The pressure lubrication system as defined in claim 11 further comprising an apparatus for collecting lubrication fluid leaked from the vent tubes during a transient period of time between tank orientation changes.

* * * * *